US006776203B1

(12) United States Patent
Cecchi

(10) Patent No.: US 6,776,203 B1
(45) Date of Patent: Aug. 17, 2004

(54) DEVICE FOR RAPIDLY FIXING BLADES ONTO THE SHAFTS OF WOOD PLANERS

(75) Inventor: Gianfranco Cecchi, Milan (IT)

(73) Assignee: Esse Emme di Casadei Roberto & C. S.n.c., Villa Verucchio (RN) (IT)

( * ) Notice: Subject to any disclaimer, the term of this patent is extended or adjusted under 35 U.S.C. 154(b) by 0 days.

(21) Appl. No.: 10/400,659

(22) Filed: Mar. 28, 2003

(51) Int. Cl.[7] ..... B27G 13/00

(52) U.S. Cl. ..... 144/221; 144/117.1; 407/47; 407/49; 407/42

(58) Field of Search ..... 144/218, 221, 144/230, 114.1, 117.1; 407/41, 47, 49, 120, 63, 40, 46, 42; 83/874, 698.5, 699.61, 699.21

(56) References Cited

U.S. PATENT DOCUMENTS 2,652,749 A * 9/1953 Hagmeister ..... 144/230
2,842,233 A * 7/1958 Greenleaf
3,987,525 A * 10/1976 Hasfjord ..... 407/36
4,475,425 A * 10/1984 Punater et al. ..... 407/49
4,485,858 A * 12/1984 Cecchi ..... 144/221
5,337,812 A * 8/1994 Schmitt ..... 144/230

FOREIGN PATENT DOCUMENTS

DE 2355290 A1 * 5/1975
EP 0182037 A1 * 9/1985

* cited by examiner

*Primary Examiner*—Allen Ostrager
*Assistant Examiner*—Shelley M Self
(74) *Attorney, Agent, or Firm*—Browdy and Neimark, P.L.L.C.

(57) ABSTRACT

The present invention relates to a shaft 4 for planers, of the type where the peripheral surface has, formed along it, longitudinal recesses 5 each housing a working blade 1 and a prism-shaped locking or retaining bar 2, with a system for rapidly fixing said blades, comprising two series 7 and 8 of rollers housed in succession in a recess 6 parallel to and radially inside the recess 5 and a central operating member of the screw type 13, 14 and 15 able to exert an axial thrust on the toggles formed by the rollers at the two ends of the recess 6, by means of two thrust elements 11 and 12, so as to produce, on the locking bar 2, a radial thrust sufficient for fixing the blade 1. (FIG. 3)

5 Claims, 3 Drawing Sheets

DEVICE FOR RAPIDLY FIXING BLADES ONTO THE SHAFTS OF WOOD PLANERS

BACKGROUND OF THE INVENTION

1. Field of the Invention

The present invention relates to a device for rapidly fixing blades onto the shafts of wood planers, with which it is proposed to solve in the most satisfactory, practical and cost-effective manner the problem of rapidly changing said blades when they are worn.

2. Description of the Prior Art

The shafts are of the type having formed, along their peripheral surface, longitudinal, straight or helical recesses, each of which houses, as shown by way of example in FIGS. 1 and 2 of the accompanying drawings, a blade 1 and prism-shaped locking bar 2 with counter-tightening screws 3 which press against the locking bar in a direction tangential to the shaft.

In shafts of this type, the operation of changing the blades is somewhat difficult and laborious since it involves loosening all the screws 3, replacing the blade 1 and then tightening again all the screws 3, so as to fix the blade in position again. Since there are about ten screws for each blade, the operation also requires a lot of time. If this constitutes a drawback of a not insignificant nature it can be easily understood that it becomes a very serious problem in the case of wood planer shafts which, according to the most common current trend in the sector, envisage the use of disposable blades instead of the more traditional blades which must be resharpened and adjusted in position on the shaft. In fact the efficiency and productivity of planers with disposable blades is strictly dependent upon the speed of replacing said blades.

SUMMARY OF THE INVENTION

The object of the present invention is therefore that of eliminating the abovementioned drawback by replacing, in the shafts of planers, the large number of screws used for tightening the locking bar which fixes the blades, with a rapid system which has a single central operating member.

The present invention constitutes an improvement to a prior patent in the name of the same inventor (Italian application No. 19989 A/90 filed on 11 Apr. 1990) with the same object, in which the toggles were formed by a spring steel bar folded sinusoidally or by separate diamond-shaped struts. This solution had the drawback, however, that there was a non-uniform radial pressure on the locking bar due to the sliding friction which the toggles encountered during their axial movement with an increase in the radial pressure.

The present invention aims to eliminate the abovementioned drawback by means of toggles consisting of rollers arranged with their axes staggered in succession as described below.

More precisely the present invention relates, in a blade-holding shaft for planers of the type where the peripheral surface has, formed along it, longitudinal recesses each housing a working blade and a prism-shaped locking bar, to an element for rapidly fixing said blades, characterized in that it comprises a series of roller-type toggles housed in succession in a recess parallel to and radially inside the recess housing the blade and the locking bar, and a central operating member able to exert an axial thrust on the toggles at the two free ends of the recess so as to produce, on the locking bar, a radial thrusting force for each toggle in the series.

BRIEF DESCRIPTION OF THE DRAWINGS

The invention is now described in greater detail, purely by way of example, with reference to the accompanying drawings, in which.

DETAILED DESCRIPTION OF THE PREFERRED EMBODIMENT (S)

Figure 1:
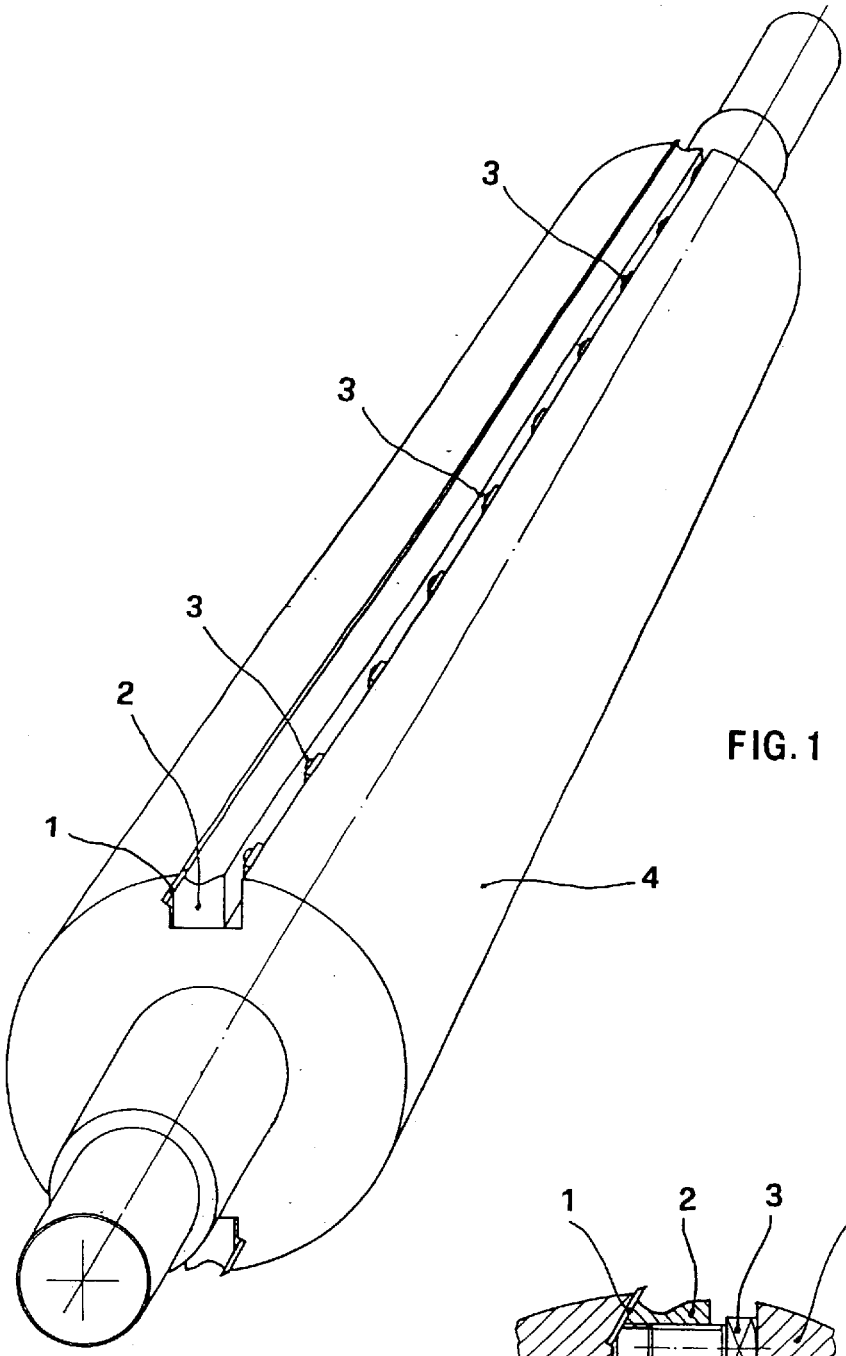
FIGS. 1 and 2 show, as already indicated, a perspective view and partial cross-section, respectively, of a blade-holding shaft for wood planers according to the conventional art.
Figure 2:
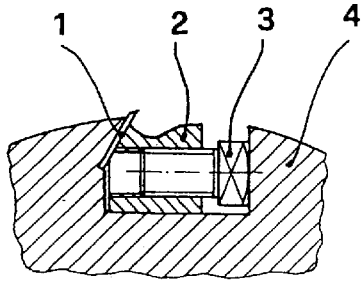
Figure 3:
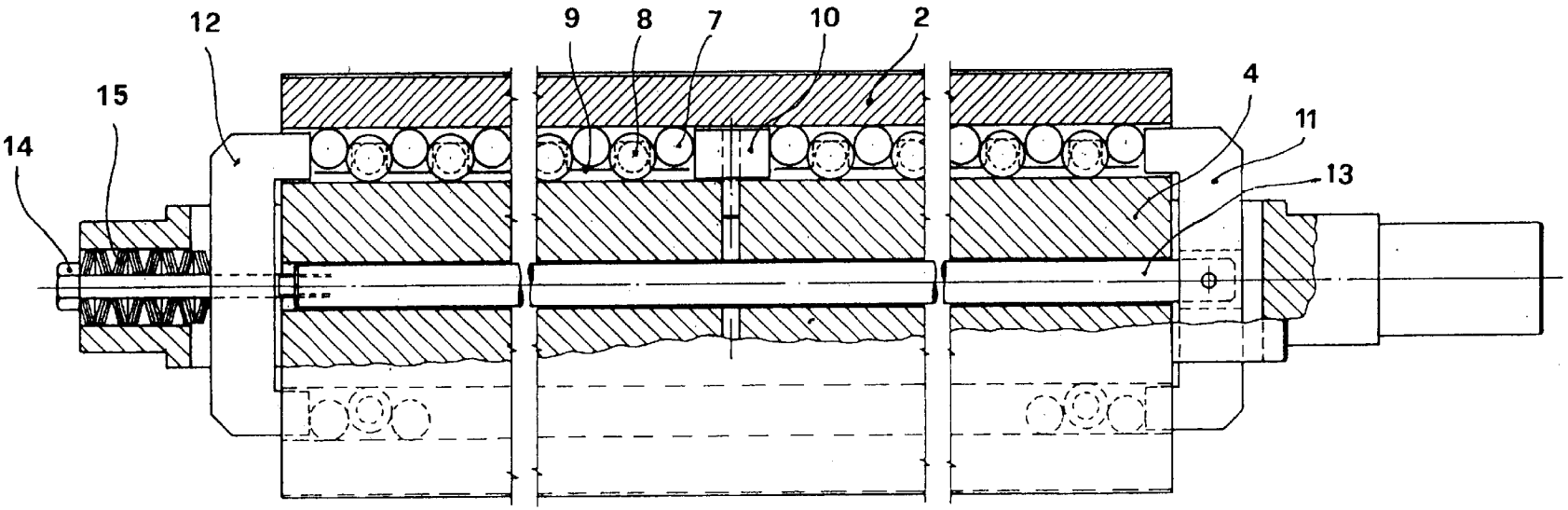
FIG. 3 shows an axial longitudinal section through a blade-holding shaft equipped with elements for rapidly fixing the blades according to the present invention.
Figure 4:
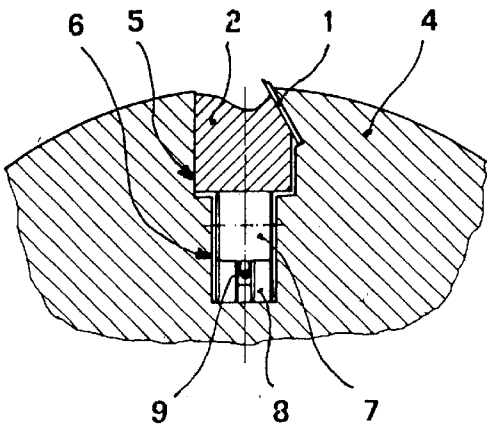
FIG. 4 shows a partial cross-section through the shaft according to FIG. 3.

All these figures refer to shafts with straight or helical disposable blades since it is in particular with these shafts that the advantages of the present invention can be appreciated. Moreover, shafts with only two blades have been shown since generally this is the solution currently preferred in helical-blade planers. However, the invention may obviously be applied to shafts with blades which can be resharpened and adjusted, as also to shafts fitted with more than two—for example three—blades. Let us now consider FIGS. 3 and 4: in the case of a blade-carrying shaft 4 with two first straight and diametrically opposite recesses 5, each first recess 5 has a form suitable for containing a prism-shaped locking bar 2 and a blade 1 with the minimum play so as to allow replacement of the blades 1 with sufficient ease. A second recess 6 housing the fixing system according to the invention is provided radially inside each first recess 5 and parallel thereto.

Figure 5:
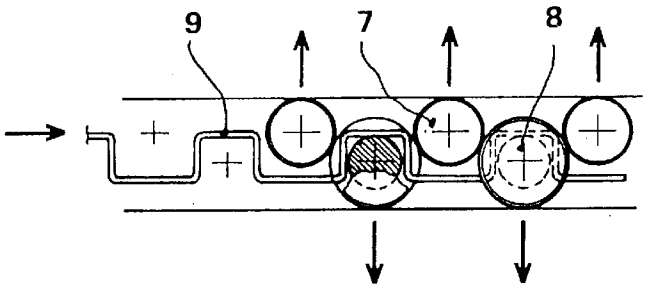
FIG. 5 show a detail of the rollers with the fretted spring.

In the case of each recess 6 the fixing system consists of two series 7 and 8 of rollers arranged alternately in contact with the locking bar 2 and the shaft 4 so as to form a continuous series of toggles which, when compressed axially, generate on the locking bar 2 the radial forces for fixing the blade 1, as shown in FIG. 5.

A central fixed element 10 divides the two series of toggles into two identical parts so as to result in symmetry both of the radial thrusts and of the travel movements of the two thrust elements 11 and 12 during slackening of the system. Said feature is an improvement since the system functions also with only one series of toggles with double the length.

The first series 7 of rollers is composed of solid cylindrical rollers, while in the case of the second series 8 the rollers 8 are centrally grooved so as to allow the seating of a fretted spring 9. Said spring 9, which is relatively light, has a dual function, namely: 1) keeping the rollers in the "toggled" position also when the system is slackened; 2) gradually spacing the rollers and the thrust elements 11 and 12 during slackening of the fixing system, since the spring 9 is mounted compressed. The system for compressing the toggles consists of thrust elements 11 and 12, a tie-rod 13, a control screw 14 and a series of Belleville washers 15. The tie-rod 13 passes inside a central bore hole of the shaft 4 and is pivotably mounted on one side with the thrust element 11 and on the other side is connected to the control screw 14 which passes through the thrust element 12. The Belleville washers 15, which are compressed during tightening of the control screw 14, have the function of maintaining the locking force even in the case of small settling movements of the locking bar during operational rotation of the shaft 4.

The operating principle of the fixing system according to the invention does not require any detailed explanation and may be briefly stated as follows: slackening the single control screw 14 results in slackening of the toggles with consequent release of the locking bar 2 and the possibility of extracting the blades 1 when they are worn, replacing them with new blades and then fully tightening again the control screw 14.

Figure 6:
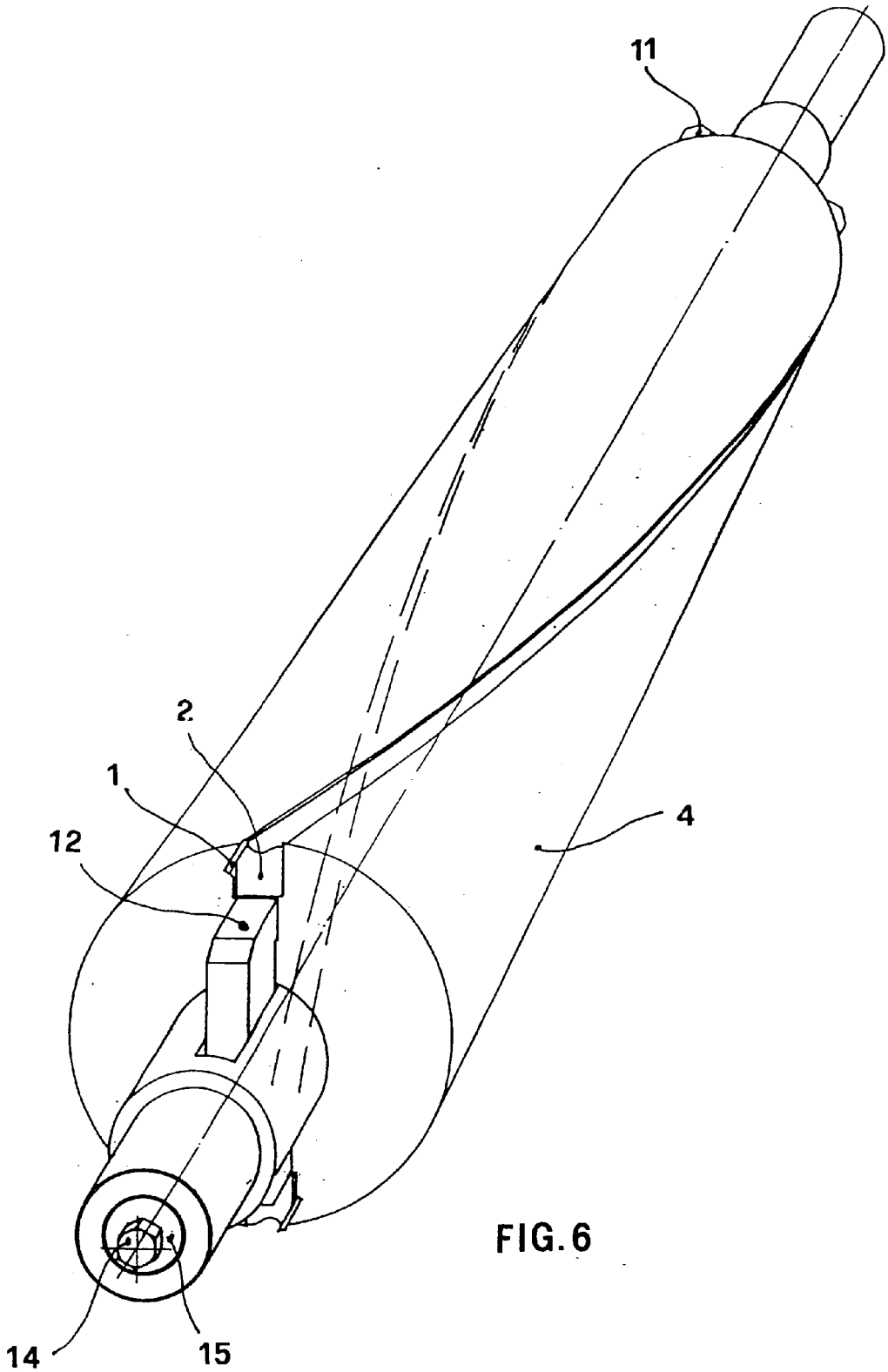
FIG. 6 shows a perspective view of the invention applied to a blade-holding shaft with helical recesses and blades.

It may be easily understood that the invention is applicable also to shafts with helical blades, as illustrated in FIG. 6, owing to the fact that, in the toggle devices, the rollers only rest against each other and are guided by the recess 6 which, in addition to being straight, may also be not only helical, but also of a different nature, for example circular.

The invention thus conceived may be subject to numerous modifications and variants, all of which fall within the scope of the inventive idea. Moreover, all the details may be replaced by technically equivalent elements.

In practice, it is obviously possible to make modifications and/or improvements which fall, however, within the scope of the following claims.

What is claimed is:

1. Device for rapidly fixing blades onto the shafts of wood planers, of the type where the peripheral surface has, formed along it, straight or helical longitudinal recesses, each housing a working blade and a prism-shaped retaining or locking bar, comprising a series of roller-type toggles housed in succession in a recess parallel to and radially inside the recess housing the blade and the locking bar, in opposition to two thrust elements at the two ends, operated by a central member able to exert an axial thrust on said series of toggles so as to produce a radial thrust on the locking bar for fixing the blade.

2. Fixing device as claimed in claim 1, the operating member of which consists of a single central control screw which is coaxial with the shaft and acts on a tie-rod so as to adjust simultaneously the two thrust elements.

3. Fixing device as claimed in claim 1, in which the tensile force exerted by the central control screw is maintained by a set of Belleville washers also in the case of small settling movements of the locking bar and blade.

4. Device for rapidly fixing blades onto shafts of wood planers, of the type where the peripheral surface has, formed along it, straight or helical longitudinal recesses, each housing a working blade and a prism-shaped retaining or locking bar, comprising a single series of roller-type toggles housed in succession in a recess parallel to and radially inside the recess housing the blade and the locking bar, in opposition to a thrust element on one side and a blind recess on the other side, operated by a central member able to exert an axial thrust on said series of toggles so as to produce a radial thrust on the locking bar fixing the blade.

5. Device for rapidly fixing blades onto the shafts of wood planers, of the type where the peripheral surface has, formed along it, straight or helical longitudinal recesses, each housing a working blade and a prism-shaped retaining or locking bar, comprising two series of roller-type toggles separated by a central fixed element housed in succession in a recess parallel to and radially inside the recess housing the blade and the locking bar, in opposition to two thrust elements at the two ends, operated by a central member able to exert an axial thrust on said series of toggles so as to produce a radial thrust on the locking bar for fixing the blade.

* * * * *